US009393975B2

(12) United States Patent
Chen

(10) Patent No.: US 9,393,975 B2
(45) Date of Patent: Jul. 19, 2016

(54) INTEGRATED VEHICLE SAFETY MONITORING SYSTEM FOR RUNNING TRAINS

(71) Applicant: CHENGDU KNIGHT TECHNOLOGY CO., LTD., Chengdu (CN)

(72) Inventor: Lu Chen, Chengdu (CN)

(73) Assignee: CHENGDU KNIGHT TECHNOLOGY CO., LTD., Chengdu (CN)

( * ) Notice: Subject to any disclaimer, the term of this patent is extended or adjusted under 35 U.S.C. 154(b) by 64 days.

(21) Appl. No.: 14/258,218

(22) Filed: Apr. 22, 2014

(65) Prior Publication Data

US 2014/0312179 A1 Oct. 23, 2014

(30) Foreign Application Priority Data

Apr. 22, 2013 (CN) ..... 2013 1 0138810
Jun. 13, 2013 (CN) ..... 2013 1 0233861

(51) Int. Cl.
*B61L 15/00* (2006.01)
*B61L 27/00* (2006.01)

(52) U.S. Cl.
CPC ..... *B61L 15/0027* (2013.01); *B61L 15/0081* (2013.01); *B61L 27/0094* (2013.01)

(58) Field of Classification Search
CPC ..... B61K 9/00; B61K 9/04; B61K 9/06; B61L 1/00; B61L 1/02; B61L 1/14; B61L 1/16; B61L 1/165; B61L 1/166; B61L 1/18; B61L 3/00; B61L 3/002; B61L 3/004; B61L 3/02; B61L 3/08; B61L 15/00; B61L 15/0063; B61L 15/0081
USPC ..... 246/120, 122 R, 124, 167 R–169 D, 191, 246/192 R, 218–220
See application file for complete search history.

(56) References Cited

U.S. PATENT DOCUMENTS

| | | | | |
|---|---|---|---|---|
| 5,331,311 | A * | 7/1994 | Doctor | B61K 9/06 246/169 A |
| 6,416,020 | B1 * | 7/2002 | Gronskov | B61K 9/12 246/169 D |
| 7,946,537 | B2 * | 5/2011 | Mathews, Jr. | B61K 9/04 246/169 A |
| 2009/0173839 | A1 * | 7/2009 | Groeneweg | B61L 23/042 246/15 |
| 2010/0155543 | A1 * | 6/2010 | Hesser | B61K 9/06 246/169 D |
| 2012/0181390 | A1 * | 7/2012 | Ashraf | B61L 29/28 246/122 R |

* cited by examiner

*Primary Examiner* — R. J. McCarry, Jr.
(74) *Attorney, Agent, or Firm* — Hamre, Schumann, Mueller & Larson, P.C.

(57) ABSTRACT

An integrated vehicle safety monitoring system for running trains, comprises a trackside multi-sensor fieldbus intelligent detection unit, a multivariate information processor transfer computer unit, a trackside wireless communication unit and a detection station monitoring information control terminal. Integrating a plurality of detection functions together, the system realizes intelligent multi-sensor information fusion, conducts diversified and parallel processing to various parameters, and greatly expands the monitoring space based on wireless communication, thereby comprehensively improving the system monitoring capacity and enabling the monitoring success rate to be greatly improved. The detection station monitoring information control terminal uploads the processed data to a superior vehicle safety monitoring center and a system cloud processing unit to realize the instant sharing of information between the units.

6 Claims, 2 Drawing Sheets

INTEGRATED VEHICLE SAFETY MONITORING SYSTEM FOR RUNNING TRAINS

TECHNICAL FIELD

The present invention belongs to the field of railway vehicle running safety detection, and particularly relates to an integrated detection system for detecting each vehicle safety parameter of trains in real time.

BACKGROUND

The railway 5T system has existed for more than 40 years from the earliest THDS. The so-called 5T system mainly includes five independent system units, i.e., Train Coach Running Diagnosis System (TCDS), Trace Hotbox Detection System (THDS), Trackside Acoustic Detection System (TADS), Trouble of Moving Freight Car Detection System (TFDS) and Track Performance Detection System (TPDS), where, expect that TCDS is disposed in a running train, other four independent system units are separately disposed in four different detection stations on the trackside of railway steel rails and work independently. By a trackside single-function sensor, the detected vehicle-related safety information of trains running therethrough is transmitted, via wired cables, to hosts in different detection stations to be processed, and then the results of processing are transmitted to a superior vehicle safety monitoring center over a wired transmission network.

The wide application of the 5T system in the railway field plays a critical role in avoiding various accidents of running trains, for example, the occurrence of hotbox of vehicle axles, the falling-off of assemblies of running trains, etc., so that the probability of accidents of running trains is reduced greatly. With the continuous development of railway transportation, higher requirements on the stability and accuracy of the 5T system are proposed correspondingly. In other words, this requires the 5T system to successfully monitor trains within a certain region no matter in which state they are, and to acquire the safety state parameters of all running trains to be monitored integrally, accurately, reliably, comprehensively and thoroughly at one time.

These parameters include: running temperature distribution state of vehicle axles, whether or not sudden breakage occurs on the vehicle axle bearings, whether or not falling-off or deformation occurs on components related to the vehicle walking parts and vehicle chassis, whether or not there is any failure that the vehicle wheels are locked by the brake shoes, whether or not the heat distribution among the vehicle wheels is normal during the running, whether or not there is any unbalanced loading, etc. In this way, intuitive, scientific, and more reliable and accurate information can be provided for the train running safety command authority and the related command authorities to exactly master and dynamically track the vehicle safety state parameters of running trains.

However, there are many problems in the practical applications of the 5T system due to the restriction of its own technical conditions.

(1) As 5T consists of five different and independent system units, each of which detects different safety parameters, there is lack of comprehensive analysis and application of various parameters by multiple sensors, as a result, no complementary and comprehensive detection data can be provided for the system failure detection.

(2) With respect to the data information of 5T, the analog information collected by a trackside sensor is transmitted to a detection station, then the analog information is converted into corresponding digital information by the detection station through secondary processing, and the digital information is finally stored, judged and then processed.

(3) A Trace Hotbox Detection System (THDS) is provided in the 5T system. When an axle breaks down, it usually makes the axle temperature abnormal. Therefore, the failure of the axle may be found by detecting the axle temperature. To avoid missed detection, wrong detection and other errors, two different sensors are disposed in the trackside hot axle detection regions, respectively, in order to realize accurate detection. However, as both sensors are infrared thermistor temperature sensors which can detect the local temperature of the axles within a very small range (less than 40 $mm^2$) only, but not the heat distribution of the vehicle axles as a whole, even not the temperature distribution outside of the train wheels, brake shoes and bogies. The failure of the wheels, brake shoes and bogies cannot be found in time and thus the requirement on comprehensive detection of train running safety parameters cannot be met.

(4) The trackside sensors of the 5T system are connected to the hosts in the detection stations via wired cables. However, as railways are ramified over the country and the environment of the railway trackside in some regions is very harsh, many connection cables have various failures correspondingly due to long-term work in the harsh environment, quite challenging the normal application of 5T and resulting in increased application and maintenance cost.

(5) As there is no industrial control computer for separately processing data information of the wheel sensors, the overall detection is abnormal when the speed of a running train is below 15 km/h, as a result, all results of detection are unreliable, unbelievable and unavailable. When the monitored train is in states in which a running train often encounters: for example, abruptly accelerates/decelerates, or, stops and then runs again, etc., the results of detection are invalid completely, just like the case mentioned above.

(6) There is no any monitoring camera device both indoor and outdoor the detection stations of the 5T system, so the outdoor working environment and indoor working situation cannot be known. When a trackside sensor breaks down, the system will be disabled due to the lack of further countermeasures.

SUMMARY

In view of the above deficiencies, an object of the present invention is to provide an integrated vehicle safety monitoring system for running trains, which can comprehensively detect running safety parameters of trains and has high accuracy of detection and good instantaneity.

To solve the above problems, the following technical solutions are employed by the present invention:

an integrated vehicle safety monitoring system for running trains is provided, comprising:

a trackside multi-sensor fieldbus intelligent detection unit, located outside of steel rails, and configured to detect data information of trains running through this region in a normal state, or in a state of varying suddenly in speed, abruptly stopping, stopping and then running again, the multi-sensor fieldbus of the trackside multi-sensor fieldbus intelligent detection unit being fitted with sensors to gather, distribute and transmit the data information detected by the sensors;

a multivariate information processor transfer computer unit, configured to buffer, store and transfer the data information transmitted from the multi-sensor fieldbus;

a trackside wireless communication unit, configured to wirelessly transmit the data information in the multivariate information processor transfer computer unit to a detection station monitoring information control terminal outside of the steel rails; and a detection station monitoring information control terminal, provided with a wireless communication unit fitted with the detection station system bus, and configured to perform data transmission with the trackside wireless communication unit, the detection station monitoring information control terminal inducing, analyzing, comparing, calculating and handling the data information transmitted from the trackside wireless communication unit in real time and uploading the processed data to a superior vehicle safety monitoring center and a system cloud processing unit to realize instant sharing of information between the units.

Working process and principle of the present invention are as follows:

various safety parameters of a running train are collected by various sensors fitted with a trackside multi-sensor fieldbus, and then coupled to a multivariate information processor transfer computer unit via a field industrial control bus to be converted into corresponding digital information for purpose of storing in real time, tracing and making a response; various data information are integrated to a trackside wireless communication unit, and then transmitted in real time to a detection station monitoring information control terminal by the trackside wireless communication unit; and, all the information is induced, analyzed, compared, calculated, handled and stored by the detection station in real time, and then uploaded by a data exchanger in the detection station to a superior vehicle safety monitoring center and a system cloud processing unit to realize instant sharing of information between the units.

Compared with the prior art, the present invention has the following advantages:

1. Various safety parameters of a train running therethrough collected by the multiple sensors on the trackside are integrated to a multi-sensor fieldbus. The multi-sensor fieldbus has a dedicated data flow channel, so that the redundancy of fusion of data from the multiple sensors on the trackside is ensured and the concentrated transmission of the data information is realized. This facilitates the comprehensive analysis and application of various parameters, and provides complementary and comprehensive detection data for the system failure detection.

2. The multivariate information processor transfer computer unit performs direct digitization to all analog information collected by the multiple sensors. As a result, the interference and distortion during the transmission of analog information from the trackside multi-sensor fieldbus intelligent detection unit to the detection station are avoided, the interference and distortion during the analog-to-digital conversion performed by the host in the detection station are also avoided, and the speed and reliability of the system in processing information are improved.

3. The wireless transmission of data information by the wireless communication unit avoids unreliable information transmission, even breakdown of the system, resulted from easy damage to the wired cables between the trackside and the detection station. Thus, the application and maintenance cost is saved greatly.

Further, the trackside multi-sensor fieldbus intelligent detection unit includes: an infrared thermal imaging and temperature-measuring sensor, which is located outside of the steel rails, faces the wheels, axles, brake shoes, damper springs and walking frames of a train, and is configured to collect images and temperature information of the wheels, axles, brake shoes, damper springs and walking frames related to the running safety in all running states of a train to be monitored.

Further, the trackside multi-sensor fieldbus intelligent detection unit includes one or more of the following sensors:

a trackside optical imaging sensor, which is located outside of the steel rails, faces the wheels, axles, brake shoes, damper springs and walking frames of a train, and is configured to collect images of the wheels, axles, brake shoes, damper springs and walking frames;

a track-core optical imaging sensor, disposed on the track-core just below a train crossbeam, connected to the trackside multi-sensor fieldbus via cables, and configured to collect position images of crossbeam walking components on the bottom of a train;

a full-spectrum acoustic sensor, disposed outside of the steel rails and configured to monitor sound from a running train;

a tilt sensor, disposed on the track-core just below the train crossbeam, connected to the multi-sensor fieldbus via cables, configured to monitor the unbalanced loading of a running train; and a passive wheel sensor, disposed on the steel rails and configured to detect the total number of axles of a train.

On account of the above technical characteristics, the system can monitor various safety parameters of a running train accurately, reliably and comprehensively:

the infrared thermal imaging and temperature-measuring sensor can detect temperature and distribution of a monitored object within a detection region by receiving the infrared rays of the monitored object, even form the images of the monitored object, so as to obtain the overall temperature distribution and images of vehicle axles, the overall temperature distribution and image of vehicle wheels, the working condition images and temperature monitoring of the vehicle wheel brake shoes, and the working condition images and temperature monitoring of damper springs outside of the vehicle bogies, so that the temperature and working states (images) of the axles, wheels, brake shoes and the damper springs outside of the bogies can be monitored comprehensively, and the defects, such as, narrow detection spectrum range of an infrared thermistor temperature sensor and interference from high temperature of local points irradiated by sunlight, are overcome.

According to the temperature distribution and images of key walking components of a train obtained by the infrared thermal imaging and temperature-measuring sensor, in combination with clearer images of these components obtained by the trackside optical imaging sensor, images of the vehicle bogie and of the lower part of the middle crossbeam below the vehicle bogie obtained by the track-core optical imaging sensor, the audio of train running states detected by the full-spectrum acoustic sensor and the tilt detected by the tilt sensor, by comprehensively analyzing and judging the temperature, images, sound and other information, the current safety state of the vehicle may be obtained more comprehensively, accurately and reliably.

It is because of the use of various sensors of different functions which cover the whole detected region alternatively, the monitoring space is expanded greatly, the system monitoring capacity is improved comprehensively, and the monitoring success rate is improved greatly. The multi-objective accuracy and high-awareness collection and judgment in terms of comprehensive information gathering greatly reduce the uncertainty of the object and event during the vehicle running safety parameter detection and increase the intelligent comprehensive information processing capacity of the system by orders of magnitude, so that the possible wrong monitoring probability is minimized. The railway transportation capacity is ensured highly and reliably while greatly improving the safety of running on the railway, the order of railway transportation is maintained, and the cost of railway transportation is reduced.

Further, the trackside multi-sensor fieldbus intelligent detection unit further includes a rainfall sensor, the rainfall sensor being disposed outside of the steel rails and configured to monitor the weather conditions around the whole trackside multi-sensor fieldbus intelligent detection unit. The rainfall sensor may display the degree of change of the snow and rain so as to provide safeguard for the environmental safety of the trackside multi-sensor fieldbus intelligent detection unit.

Further, the multivariate information processor transfer computer unit is provided with the following hosts or units fitted with the multi-sensor fieldbus:

a trackside system environment monitoring and regulation host, configured to monitor the environmental temperature around the trackside multi-sensor fieldbus intelligent detection unit and provide a temperature regulation instruction;

a trackside multivariate industrial control host, configured to process the image data of the infrared thermal imaging and temperature-measuring sensor, the trackside optical imaging sensor and the track-core optical imaging sensor, and meanwhile process the monitor data of the tilt sensor and control the wireless transmission of all data information; and a trackside train running parameter industrial control host, configured to calculate axle data information monitored by the passive wheel sensor, to obtain the moment and speed of a train running therethrough in real time and judge the type and number of trains.

The multivariate information processor transfer computer unit performs direct digitization to all data information collected by the various sensors. As a result, the interference and distortion during the analog-to-digital conversion performed by the host in the detection station are avoided, and the speed and reliability of the system in processing information are improved.

The trackside train running parameter industrial control host separately processes the data information from the wheel sensor. The normal detection of the system may be ensured when the running train varies suddenly in speed or stops, or stops and then runs again.

Further, the detection station monitoring information control terminal is connected to an outdoor camera and an indoor camera, so that trackside images and indoor images can be acquired and transmitted to the superior vehicle safety monitoring center. When any abnormality occurs at the trackside or indoor, for example, a device at the trackside is covered by snow, in-time maintenance and processing may be performed to make the system return to normal in time.

The present invention will be further described as below in details with reference to accompanying drawings by a specific embodiment.

DETAILED DESCRIPTION

Figure 1:
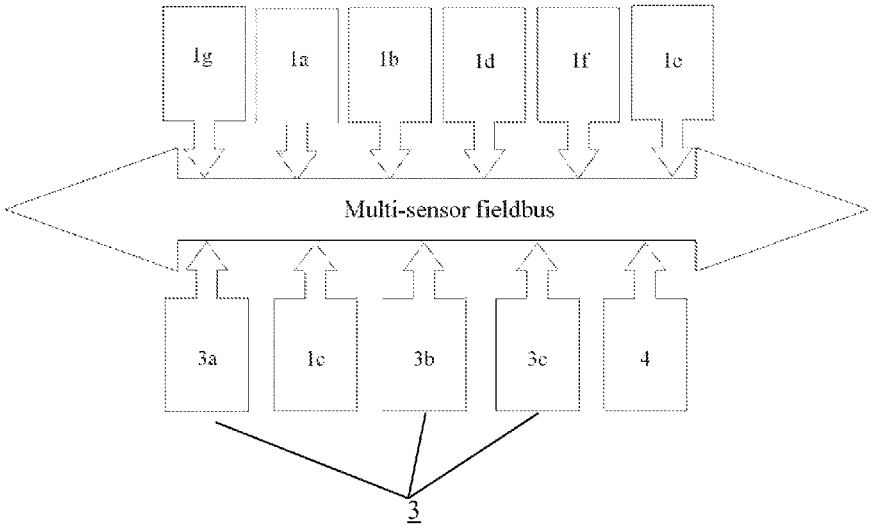
FIG. 1 is a structure diagram of a trackside multi-sensor fieldbus intelligent detection unit of an integrated vehicle safety monitoring system for running trains.
Figure 2:
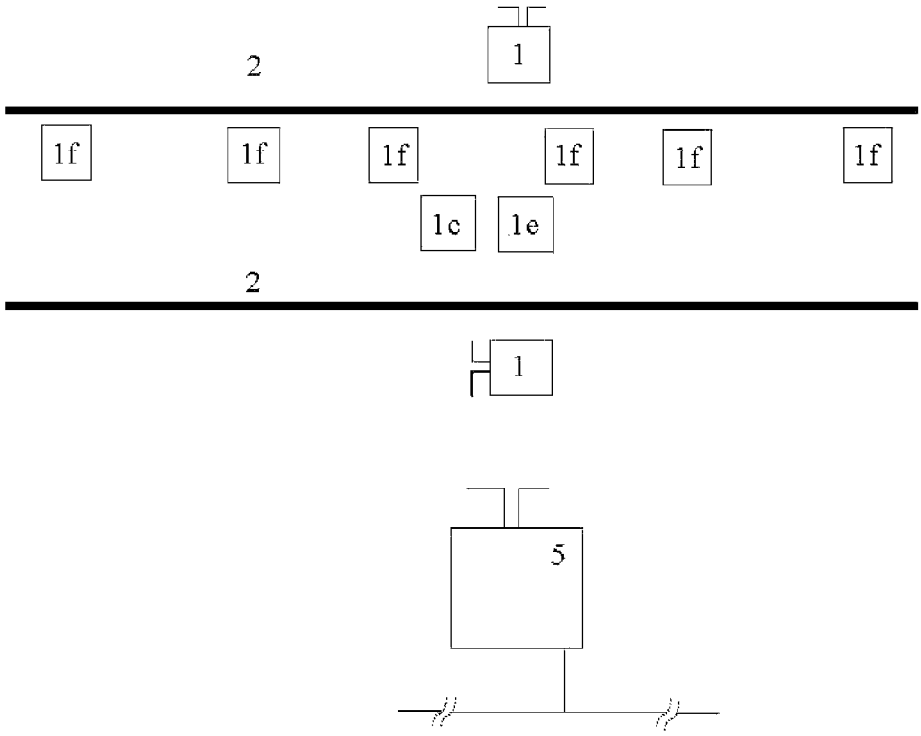
FIG. 2 is a schematic layout diagram of a trackside multi-sensor fieldbus intelligent detection unit and a detection station monitoring information control terminal of an integrated vehicle safety monitoring system for running trains.

As shown in FIG. 1 and FIG. 2, a specific embodiment of the present invention provides an integrated vehicle safety monitoring system for running trains, comprising:

a trackside multi-sensor fieldbus intelligent detection unit 1, located outside of steel rails 2, and configured to detect data information of trains running through this region in a normal state, or in a state of varying suddenly in speed, abruptly stopping, or stopping and then running again, the multi-sensor fieldbus of the trackside multi-sensor fieldbus intelligent detection unit 1 being fitted with sensors to gather, distribute and transmit the data information detected by the sensors;

a multivariate information processor transfer computer unit 3, configured to buffer, store and transfer the data information transmitted from the multi-sensor fieldbus;

a trackside wireless communication unit 4, configured to wirelessly transmit the data information in the multivariate information processor transfer computer unit 3 to a detection station monitoring information control terminal 5 outside of the steel rails 2; and a detection station monitoring information control terminal 5, provided with a wireless communication unit 5*a* fitted with the detection station system bus, and configured to perform data transmission with the trackside wireless communication unit 4, the detection station monitoring information control terminal 5 inducing, analyzing, comparing, calculating and handling the data information transmitted from the trackside wireless communication unit 4 in real time and uploading the processed data to a superior vehicle safety monitoring center 6 and a system cloud processing unit 7 to realize instant sharing of information between the units.

The trackside multi-sensor fieldbus intelligent detection unit 1 in this embodiment includes the following sensors:

an infrared thermal imaging and temperature-measuring sensor 1*a*, which is located outside of the steel rails, faces the wheels, axles, brake shoes, damper springs and walking frames of a train, and is configured to collect images and temperature information of the wheels, axles, brake shoes, damper springs and walking frames related to the running safety in all running states of a train to be monitored;

a trackside optical imaging sensor 1*b*, which is located outside of the steel rails, faces the wheels, axles, brake shoes, damper springs and walking frames of the train, and is configured to collect images of the wheels, axles, brake shoes, damper springs and walking frames;

a track-core optical imaging sensor 1*c*, disposed on the track-core just below a train crossbeam, connected to the trackside multi-sensor fieldbus via cables, and configured to collect position images of walking components on the crossbeam on the bottom of a train;

a full-spectrum acoustic sensor 1*d*, disposed outside of the steel rails and configured to monitor sound from a running train;

a tilt sensor 1*e*, disposed on the track-core just below the train crossbeam, connected to the multi-sensor fieldbus via cables, and configured to monitor the unbalanced loading of a running train; and a passive wheel sensor 1*f*, disposed on the steel rails and configured to detect the total number of axles of a train.

The trackside multi-sensor fieldbus intelligent detection unit 1 in this embodiment further includes a rainfall sensor 1*g*, the rainfall sensor 1*g* being disposed outside of the steel rails and configured to monitor the weather conditions around the whole trackside multi-sensor fieldbus intelligent detection unit 1.

The multivariate information processor transfer computer unit 3 in this embodiment is provided with the following hosts or units fitted with the multi-sensor fieldbus:

a trackside system environment monitoring and regulation host 3*a*, configured to monitor the environmental temperature around the trackside multi-sensor fieldbus intelligent detection unit 1 and provide a temperature regulation instruction;

a trackside multivariate industrial control host 3*b*, configured to process the image data of the infrared thermal imaging and temperature-measuring sensor 1*a*, the trackside optical imaging sensor 1*b* and the track-core optical imaging sensor 1*c*, and meanwhile process the monitor data of the tilt sensor 1*e* and control the wireless transmission of all data information; and a trackside train running parameter industrial control host 3*c*, configured to calculate axle data information monitored by the passive wheel sensor 1*f*, to obtain the moment and speed of a train running therethrough in real time and judge the type and number of trains.

The detection station monitoring information control terminal 5 in this embodiment is connected to an outdoor camera and an indoor camera.

What is claimed is:

1. An integrated vehicle safety monitoring system for running trains, comprising:

a trackside multi-sensor fieldbus intelligent detection unit, located outside of steel rails, and configured to detect data information of trains running through this region in a normal state, or in a state of varying suddenly in speed, abruptly stopping, or stopping and then running again, the multi-sensor fieldbus of the trackside multi-sensor fieldbus intelligent detection unit being fitted with sensors to gather, distribute and transmit the data information detected by the sensors;

a multivariate information processor transfer computer unit, configured to buffer, store and transfer the data information transmitted from the multi-sensor fieldbus;

a trackside wireless communication unit, configured to wirelessly transmit the data information in the multivariate information processor transfer computer unit to a detection station monitoring information control terminal outside of the steel rails; and the detection station monitoring information control terminal, provided with a wireless communication unit fitted with a detection station system bus, the detection station monitoring information control terminal being configured to perform data transmission with the trackside wireless communication unit, the detection station monitoring information control terminal inducing, analyzing, comparing, calculating and handling the data information transmitted from the trackside wireless communication unit in real time and uploading the processed data to a superior vehicle safety monitoring center and a system cloud processing unit to realize instant sharing of information between the units.

2. The integrated vehicle safety monitoring system for running trains according to claim 1, wherein the trackside multi-sensor fieldbus intelligent detection unit comprises an infrared thermal imaging and temperature-measuring sensor, which is located outside of the steel rails, faces the wheels, axles, brake shoes, damper springs and walking frames of a train, and is configured to collect images and temperature information of the wheels, axles, brake shoes, damper springs and walking frames related to the running safety in all running states of a train to be monitored.

3. The integrated vehicle safety monitoring system for running trains according to claim 1, wherein the trackside multi-sensor fieldbus intelligent detection unit further comprises one or more of the following sensors:

a trackside optical imaging sensor, which is located outside of the steel rails, faces the wheels, axles, brake shoes, damper springs and walking frames of a train, and is configured to collect images of the wheels, axles, brake shoes, damper springs and walking frames;

a track-core optical imaging sensor, disposed on the track-core just below a train crossbeam, connected to the trackside multi-sensor fieldbus via cables, and configured to collect position images of crossbeam walking components on the bottom of a train;

a full-spectrum acoustic sensor, disposed outside of the steel rails and configured to monitor sound from a running train;

a tilt sensor, disposed on the track-core just below the train crossbeam, connected to the multi-sensor fieldbus via cables, and configured to monitor the unbalanced loading of a running train; and a passive wheel sensor, disposed on the steel rails and configured to detect the total number of axles of a train.

4. The integrated vehicle safety monitoring system for running trains according to claim 2, wherein the trackside multi-sensor fieldbus intelligent detection unit further comprises a rainfall sensor, the rainfall sensor being disposed outside of the steel rails and configured to monitor the weather conditions around the whole trackside multi-sensor fieldbus intelligent detection unit.

5. The integrated vehicle safety monitoring system for running trains according to claim 2, wherein the multivariate information processor transfer computer unit is provided with the following hosts or units fitted with the multi-sensor fieldbus:

a trackside system environment monitoring and regulation host, configured to monitor the environmental temperature around the trackside multi-sensor fieldbus intelligent detection unit and provide a temperature regulation instruction;

a trackside multivariate industrial control host, configured to process the image data of the infrared thermal imaging and temperature-measuring sensor, the trackside optical imaging sensor and the track-core optical imaging sensor, and meanwhile process the monitor data of the tilt sensor and control the wireless transmission of all data information; and a trackside train running parameter industrial control host, configured to calculate axle data information monitored by the passive wheel sensor, to obtain the moment and speed of a train running therethrough in real time and judge the type and number of trains.

6. The integrated vehicle safety monitoring system for running trains according to claim 2, wherein the detection station monitoring information control terminal is connected to an outdoor camera and an indoor camera.

* * * * *